US006353976B1

(12) United States Patent
Sutherland

(10) Patent No.: US 6,353,976 B1
(45) Date of Patent: Mar. 12, 2002

(54) EXPANDABLE SEAMED FELT PINTLE

(75) Inventor: Paul H. Sutherland, Simpsonville, SC (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 09/407,485

(22) Filed: Sep. 28, 1999

(51) Int. Cl.[7] ..... F16G 3/02
(52) U.S. Cl. ..... 24/33 P; 24/33 R
(58) Field of Search ..... 24/31 R–31 V; 198/844.2; 474/255

(56) References Cited

U.S. PATENT DOCUMENTS 3,436,041 A 4/1969 Haller
4,806,208 A 2/1989 Penven
5,722,122 A * 3/1998 Corriveau

FOREIGN PATENT DOCUMENTS

WO WO 98/19077 * 5/1998

* cited by examiner

*Primary Examiner*—James R. Brittain
(74) *Attorney, Agent, or Firm*—Volpe and Koenig, P.C.

(57) ABSTRACT

An expandable monofilament pintle, either solid or hollow, that is inserted in a channel formed by a plurality of intermeshed loops at the ends of a papermaking fabric is expanded by means of exposure to either chemicals, high temperature, or some other form of triggering mechanism to pull the fabric ends closer together to form a tight seam.

7 Claims, 3 Drawing Sheets

EXPANDABLE SEAMED FELT PINTLE

BACKGROUND OF THE INVENTION

The present invention generally relates to a woven fabric which is rendered endless by interdigitating a plurality of loops which are on the two ends of the fabric. More particularly, it relates to a pintle connector which is inserted through the aligned loops to close the seam. Even more specifically, it relates to a seaming pintle, either solid or hollow, that is expandable after insertion through the aligned loops of a seam to tighten the connection.

Fabrics used on a papermaking machine are often woven open ended so that the ends of the fabric can be joined by a seam to form an endless fabric. A typical seam for a papermakers fabric includes a plurality of loops on each end of the fabric. The loops are generally aligned in an alternating intermeshing relationship to form a channel through which a pintle is inserted to close the seam.

As papermaking machines have developed, machine speeds ranging between four thousand (4,000) and five thousand (5,000) feet per minute have become common. Additionally, papermaking fabrics are maintained under tremendous stress and tension while being used in the forming, press or dryer position on a papermaking machine. As a result of the high speeds and the increased temperature, moisture, and seam pintle strength, as well as increased pressure and operational conditions to which the seam is exposed, surface marking characteristics and wear resistance have become prime considerations. Accordingly, efforts have been made to increase seam strength by increasing the diameter of the pintle. The diameter of the pintle wire depends on the channel size formed by the aligned interdigitating loops. The form, size, number and arrangement of the loops together with the dimension and structure of the pintle determine the ease and speed at which a seam will be joined. Increasing the diameter of the pintle requires increasing the diameter of the loops and possibly the fabric caliper in the seam area. The increased thickness may produce imperfections in the product or cause machine vibrations due to imbalance during running of the machine. Furthermore, seamed fabrics often experience other problems, including surface property variations, such as void volume and permeability, in the seam area. Surface property variations between the fabric and the seam area can cause undesirable marking on the paper product.

Various known seams utilize a joining wire or pintle which is inserted through seam loops at each end of the fabric to render it endless. Current pintles are made of standard monofilament, mechanically attached by a swedge to a lead wire. The wire is pushed through the interlocked loops and the monofilament cables of various size and number are pulled in to fill the loops. This process is adequate, but still leaves a looseness to the connection that allows the seam to separate. That separation results in the batt opening at the seam and creates a mark in the sheet. It also causes a noise at the vacuum box and can lead to premature seam wear.

Another type of known pintle expands to form protrusions to fill voids in the seam area. Although filling the voids reduces marking on the paper sheet, the pintle does not pull the ends of the fabric together. The pintle therefore must be inserted into a channel that is just slightly larger than the diameter of the pintle, if the seam is to be tight. This makes insertion of the pintle more difficult and time consuming.

An expandable pintle that pulls the fabric ends together to form a tight seam would be beneficial in solving the aforementioned problems.

SUMMARY

The present invention is an expandable pintle for joining a seam comprised of a plurality of intermeshed loops at the end of a papermaking fabric to render the fabric endless. The pintle has an initial configuration which is smaller than the channel formed by the loops, and expands after insertion to create a tight connection.

BRIEF DESCRIPTION OF THE DRAWINGS

The present invention will be described with reference to the examples illustrated by the accompanying drawings in which.

DETAILED DESCRIPTION OF THE PREFERRED EMBODIMENT(S)

Figure 1:
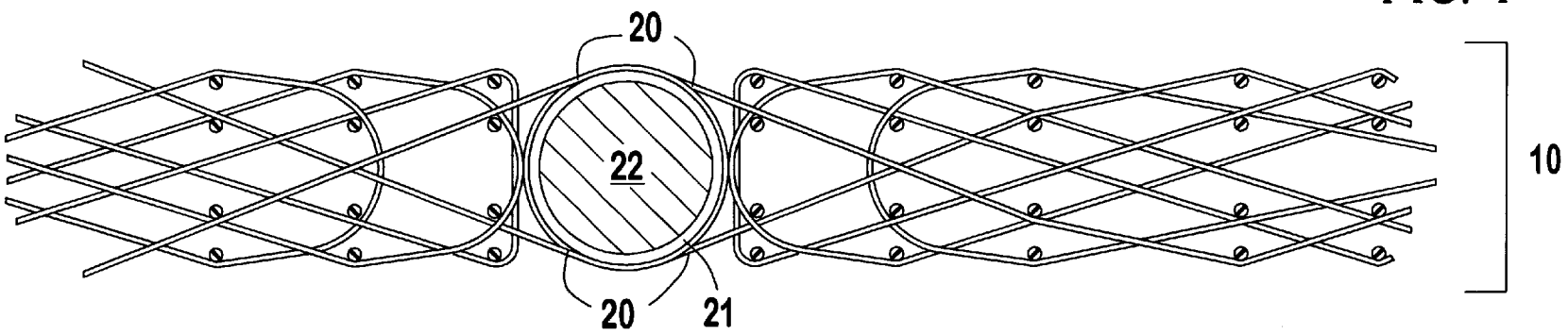
FIG. 1 is a side elevation of a pintle of the present invention as installed in the seaming channel of a fabric, prior to expansion.

The preferred embodiments will be described with reference to the drawing figures where like numerals represent like elements throughout.

Figure 2:
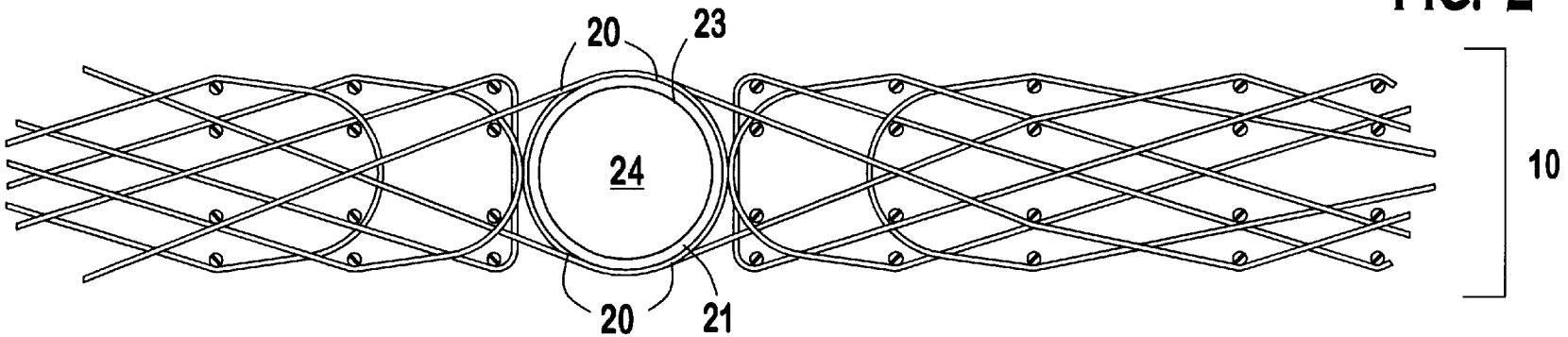
FIG. 2 is a side elevation of another embodiment of the present invention as installed.

Referring now to the drawings, and particularly to FIGS. 1 and 2, the seam area of fabric 10 is comprised of loops 20 that form a channel 21 within which either pintle 22 or 23 is inserted. The fabric 10 found throughout the figures consists of lengthwise yams and transverse yams as is well known in the art. Pintle 22 is illustrated as a solid fiber while pintle 23 is shown as a hollow fiber.

The embodiment shown in FIG. 1, comprises a monofilament pintle 22 that expands upon exposure to a triggering mechanism, such as heat, or chemicals. The monofilament pintle 22 as installed has an initial diameter that is less than the diameter of the channel 21. As such, it has reduced drag or friction and is more easily inserted into the channel 21. After the pintle 22 is inserted into channel 21, the triggering mechanism is activated, the expanding pintle 22 forces the loops 20 in opposite directions. Expandable pintles may be made out of any suitable material capable of expansion upon a triggering event. Examples include materials that are activated by heat, chemicals, or liquid, such as foaming agents similar to those used in the manufacture of polyurethane foams, and super absorbent or hydrophilic yams that swell when contacted by a liquid.

The embodiment of FIG. 2 is a hollow, pliable sleeve 23, which receives a curable resin 24. The exterior circumference of the sleeve 23 at insertion is generally equal to the desired final pintle size when filled with a resin 24, however, at insertion the sleeve 23 is collapsed, compressed or folded to easily pass through the channel 21. After insertion, it is filled under pressure with the resin 24. The sleeve 23 expands to its selected outer diameter under pressure and draws the seam tight.

Figure 3:
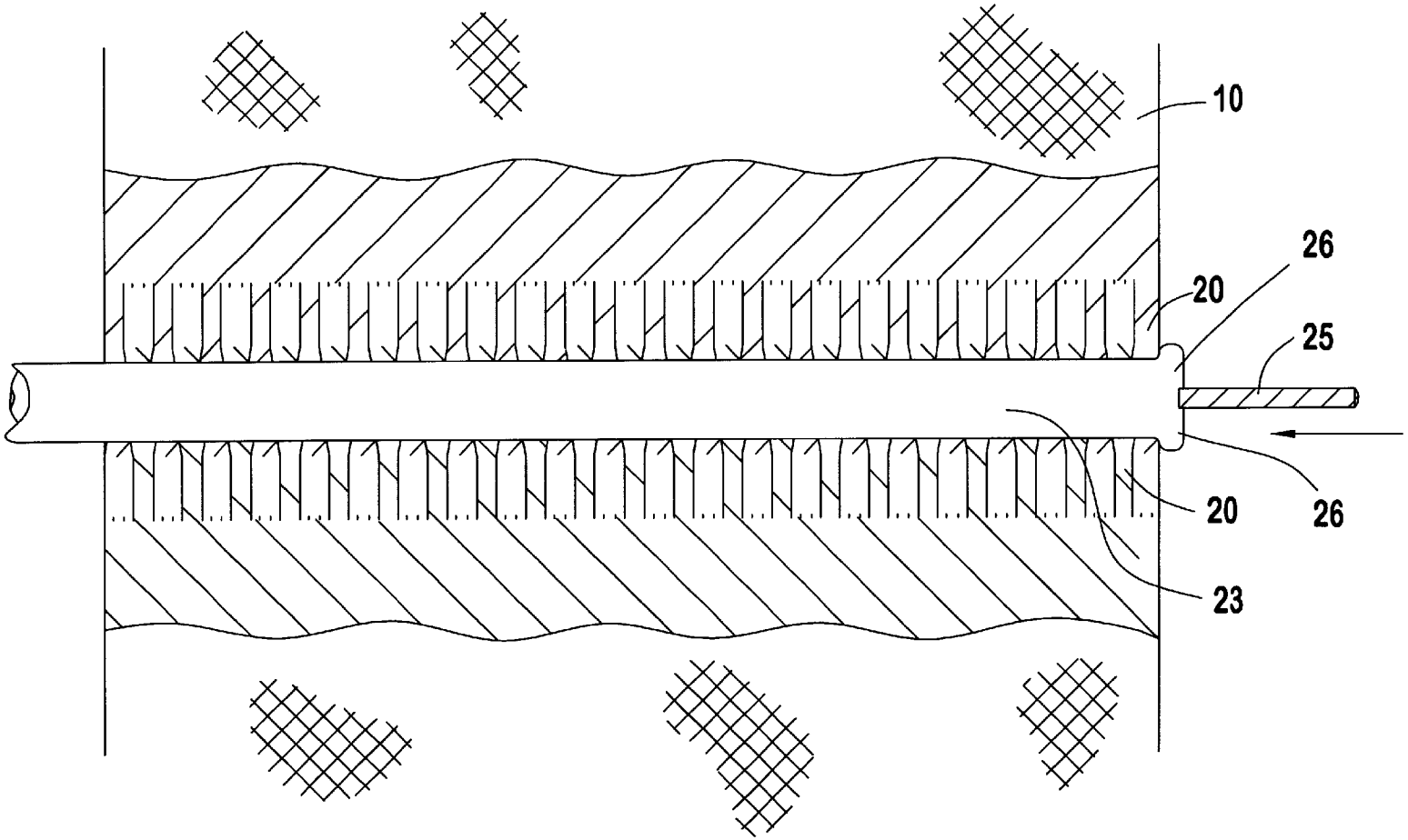
FIG. 3 is a illustrative view of a fabric with another embodiment of the present invention.

The embodiment shown in FIG. 3 has a tough outer shell 23, which is comprised of flexible material that expands when inflated under pressure through valve 25. The sleeve 23 is held against one fabric edge by the ferrule 26 adjacent valve 25 to prevent sliding and to ease the process of inserting the sleeve 23. Once the expandable sleeve 23 is inserted, a second ferrule 26 is attached, the end is trimmed to size and the end is closed such as by curing. It is then inflated through the valve 25 and causes the outer sleeve 23 to expand and form a tight seam connection.

The pintle sleeve must be pliable enough to allow it to shrink for ease of insertion, while being strong enough when inflated to hold the seam. Much like a tire inner tube, the material must balance pliability with strength requirements. The material should have a durometer hardness in the range of 20 to 70.

Figure 4:
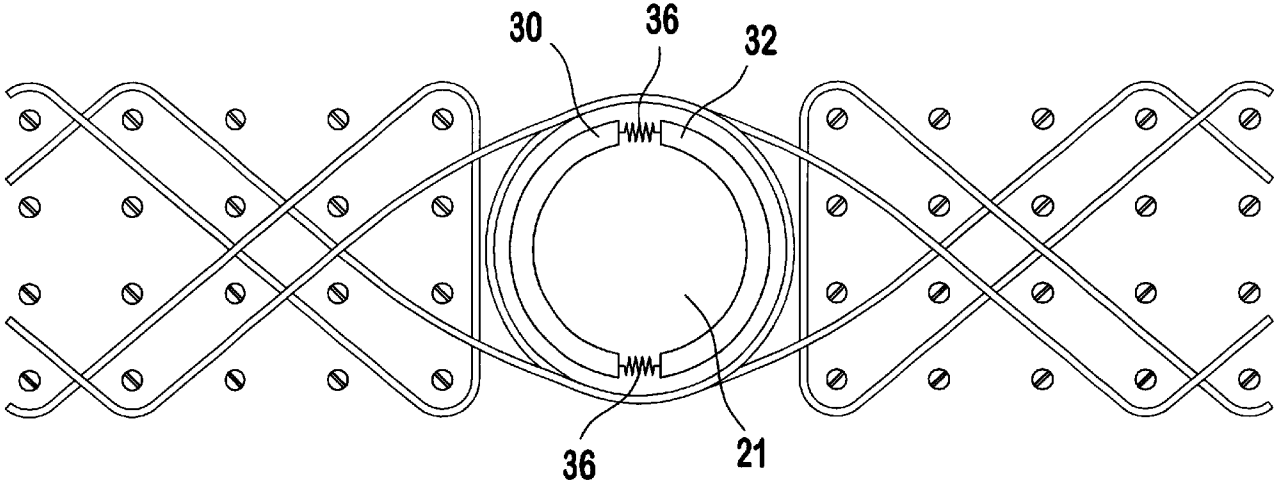
FIG. 4 is a side elevation of the illustrative embodiment of FIG. 3 as installed.
Figure 5:
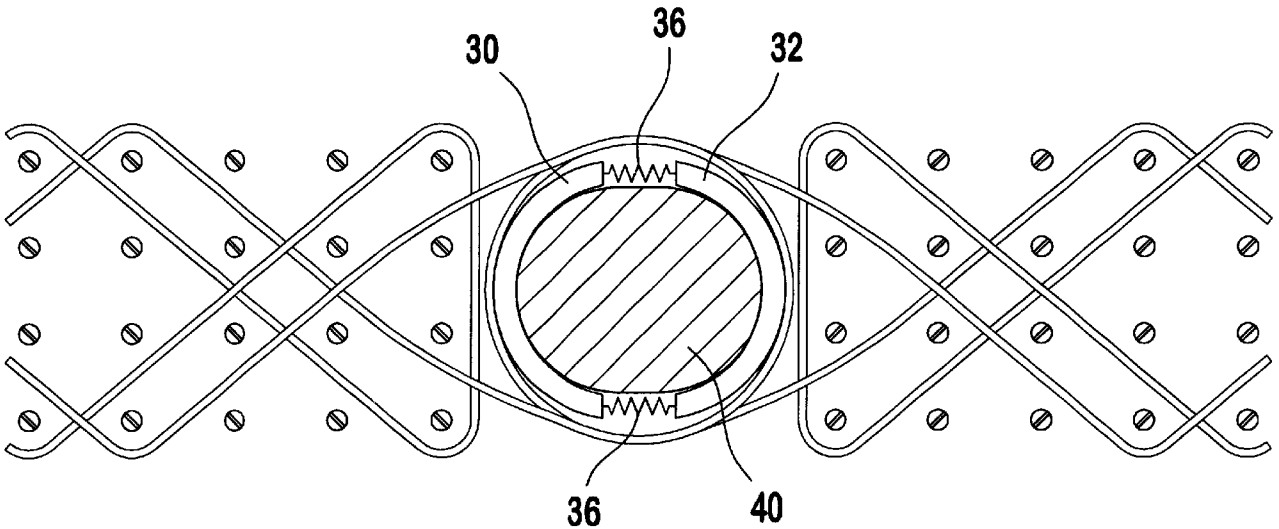
FIG. 5 is a side elevation of the illustrative embodiment of FIG. 3 as expanded.

FIGS. 4 and 5 illustrate a sheath 32 that is used to protect the expandable pintle from abrasion and other deleterious effects caused by movement of the seam loops. The sheath 32 can be constructed of metal, plastic or other hard surface substances. In the example, the sheath 32 has two semi-circular halves or opposed arcs 30, 32 joined together by accordion like expansion means 36. The expansion means 36 allows the sheath 32 to be collapsed for easy insertion, and to expand to accommodate the expandable pintles described above. FIG. 4, shows a cross sectional view of the sheath 32 as installed in the channel 21. FIG. 5 shows the same sheath 32, with the pintle 40. The sheath arcs 30 and 32 define a protective member that also can increase the pintle's strength, durability, and evenness in the seam. It is generally preferred that the expansion means 36 be maintained within the perimeter of the sheath 32 and interiorly from the rotation parts.

What is claimed is:

1. An expandable pintle for joining endless an industrial fabric having ends which include a plurality of loops that are intermeshed to define a pintle receiving channel, the pintle comprised of:

a flexible outer shell having closed first and second ends and a valve at one of said ends for introducing an expansion medium into the outer shell and expanding the pintle from an initial dimension to a desired final dimension.

2. The expandable pintle of claim 1 wherein the expansion medium is air.

3. The expandable pintle of claim 1 wherein the expansion medium is a curable resin.

4. The expandable pintle of claim 1 wherein the expansion medium is responsive to a triggering mechanism selected from the group consisting of heat, chemicals and water.

5. The pintle of claim 1 wherein the flexible outer shell is comprised of at least two portions joined together by an expandable means.

6. The pintle of claim 5 wherein the expandable means is in the form of an accordion fold.

7. The pintle of claim 1 wherein the flexible material has a durameter hardness in the range of 20–70.

* * * * *

UNITED STATES PATENT AND TRADEMARK OFFICE

CERTIFICATE OF CORRECTION

PATENT NO. : 6,353,976 B1
DATED : March 12, 2002
INVENTOR(S) : Paul H. Sutherland It is certified that error appears in the above-identified patent and that said Letters Patent is hereby corrected as shown below:

Column 2,
Line 20, after the word "is", delete "a" and insert therefor -- an --.
Line 53, after the word "hydrophilic", delete "yams" and insert therefor -- yarns --.

Signed and Sealed this

Third Day of December, 2002

JAMES E. ROGAN
*Director of the United States Patent and Trademark Office*